United States Patent [19]

Nakao

[11] 4,065,086

[45] Dec. 27, 1977

[54] LEG ASSEMBLY FOR A BABY'S GO-CART

[75] Inventor: Shinroku Nakao, Yokohama, Japan

[73] Assignee: Combi Co., Ltd., Tokyo, Japan

[21] Appl. No.: 717,422

[22] Filed: Aug. 24, 1976

[51] Int. Cl.[2] ..... A47D 13/04

[52] U.S. Cl. ..... 248/188.6; 297/5; 108/115; 272/70.3; 280/87.05; 403/94

[58] Field of Search ..... 248/188.6, 166, 439; 297/5, 136, 274, 275; 108/115, 127; 272/70.3; 280/87.05, 87.02 R, 87.02 A; 403/83, 84, 94, 102

[56] References Cited

U.S. PATENT DOCUMENTS

| | | | |
|---|---|---|---|
| 1,223,707 | 4/1917 | Lyon | 272/70.3 |
| 2,707,664 | 5/1955 | Marsilius | 108/127 |
| 2,796,268 | 6/1957 | Larson | 403/94 |
| 3,504,927 | 4/1970 | Seki | 297/5 |
| 3,796,430 | 3/1974 | Sudo | 248/188.6 |

*Primary Examiner*—Marion Parsons, Jr.

*Attorney, Agent, or Firm*—Sughrue, Rothwell, Mion, Zinn and Macpeak

[57] ABSTRACT

An assembly for a baby's go cart or walker is composed of an upper leg member, a lower leg member, and an extruded hard resin connecting member which permits the leg assembly to be folded upon itself without having any hazardous protruding parts.

1 Claim, 6 Drawing Figures

LEG ASSEMBLY FOR A BABY'S GO-CART

BACKGROUND OF THE INVENTION

The invention relates to leg assemblies for baby's go-carts, and more particularly to a leg assembly for a baby's go-cart, which can be folded.

it is well known in the art to provide a baby's go-cart or walker comprising a frame from which a seat is suspended to support a baby's body, a base frame with several wheels, and a plurality of leg assemblies provided between the two frames, and in which the leg assemblies can be folded so that the go-cart can easily be carried or stored.

However, in the conventional leg assembly, a U-shaped member and V-shaped leg member are folded down around a connecting member. Parts of the upper end portions of the V-shaped member are bent outwardly or perpendicularly to the longitudinal axis thereof. Other parts are engaged with the connecting member by penetrating therethrough. These parts protrude from the connecting member and are hazardous to a baby.

In order to overcome this drawback, a leg assembly has been proposed by Japanese Utility Model Application No. 104307/1974 which was developed by the present applicant. However, this leg assembly still suffers from the fact that its upper member and inner frame are not sufficiently combined, and it is dynamically somewhat disadvantageous.

SUMMARY OF THE PRESENT INVENTION

It is an object of the present invention to eliminate the above-described difficulties accompanying the conventional leg assemblies. This object has been completely achieved by the provision of a assembly consisting of an upper leg member having a U-shape, a lower member having a V-shape, and an extruded hard resin connecting member consisting of an inner casing and an outer casing. The upper member fits in grooves in the inner casing, and the outer casing acts only as a retaining housing therefor. The lower member has outwardly extending pivotal rods which fit in grooves in the inner casing. The two legs of the lower member fit into facing grooves on the outer face of the outer casing. Upon squeezing of the legs of the lower member, the latter can be freed from the grooves of the outer casing so as to permit pivoting of said pivotal rods within grooves of said inner casing.

DETAILED DESCRIPTION OF PREFERRED EMBODIMENT

Figure 1:
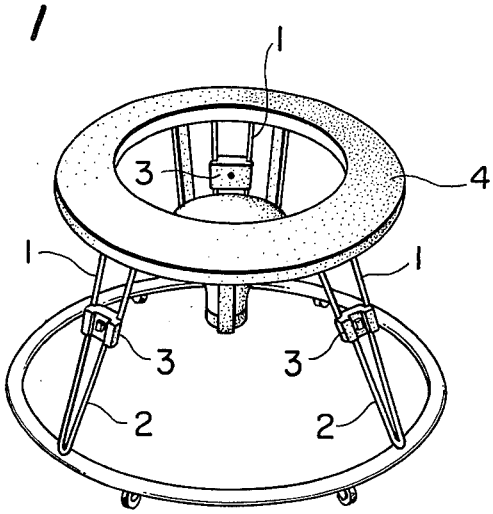
FIG. 1 is a perspective view illustrating the leg assembly of the present invention as employed in a baby's go-cart.
Figure 2:
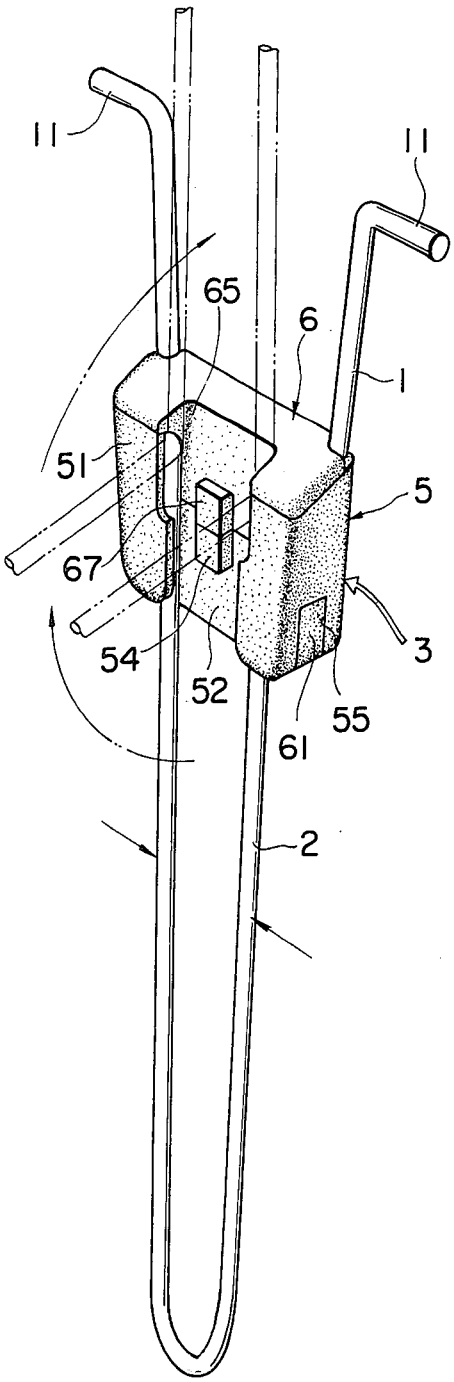
FIG. 2 is a perspective view showing the leg assembly of the present invention.

An embodiment of a leg assembly for a baby's go-cart according to this invention will be described with reference to the accompanying drawings. The leg assembly comprises: an upper member 1, a lower leg member 2, and a connecting member 3 for connecting the upper and lower members. The lower member 2 is pivotally fastened to the connecting member 3. The upper member 1 is obtained by bending a thin metallic rod into the form of a letter "U". The two end portions of the upper member 1 are bent outwardly, and serve as engaging pieces 11 which are adapted to engage with the upper frame 4, shown in FIG. 1. On the other hand, the lower member 2 is obtained by bending a thin metallic rod into the form of a letter "V" elongated. The two end portions of the lower member 2 are bent outwardly and perpendicularly to the longitudinal axis thereof, and serve as pivotal rods 21 pivotally connected to the connecting member 3.

Figure 3:
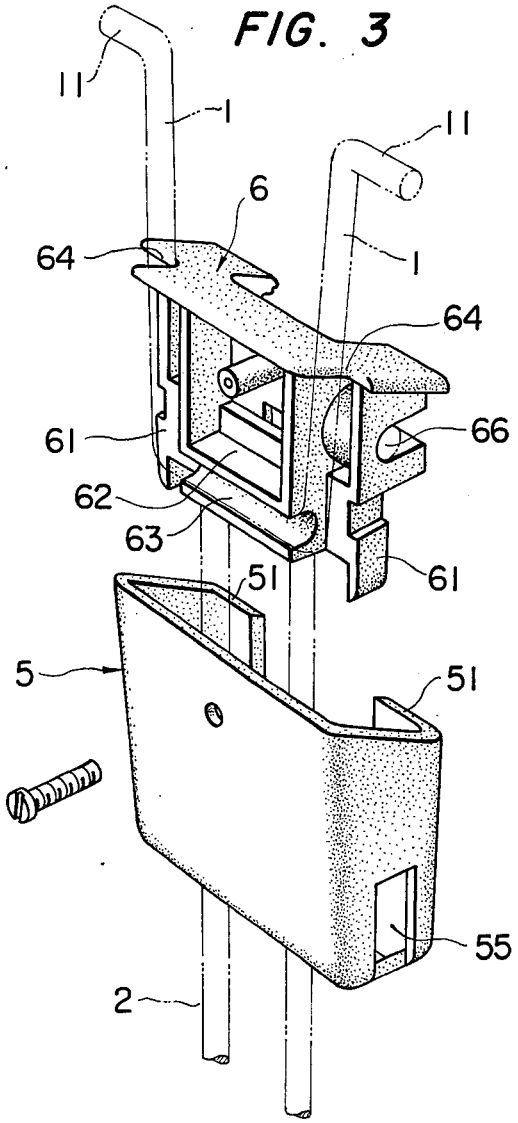
FIG. 3 is a perspective rear view illustrating exploded parts of a connecting member.
Figure 4:
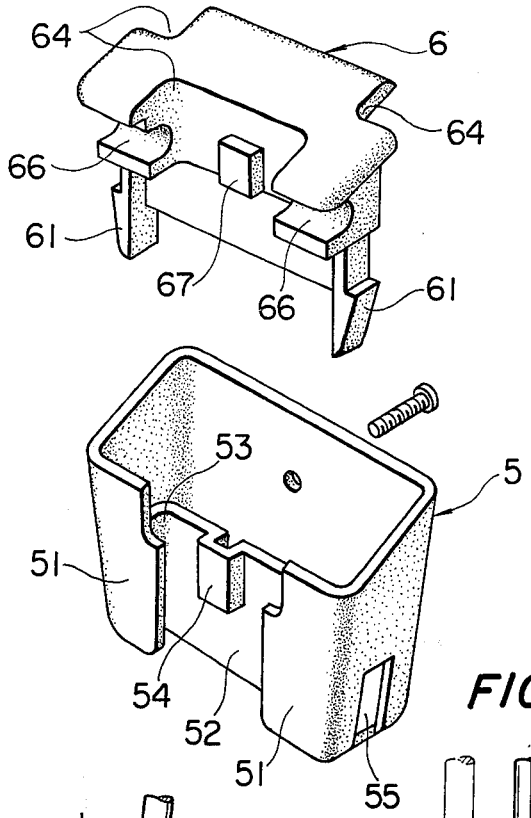
FIG. 4 is a perspective front view illustrating the exploded parts of the connecting member.
Figure 5:
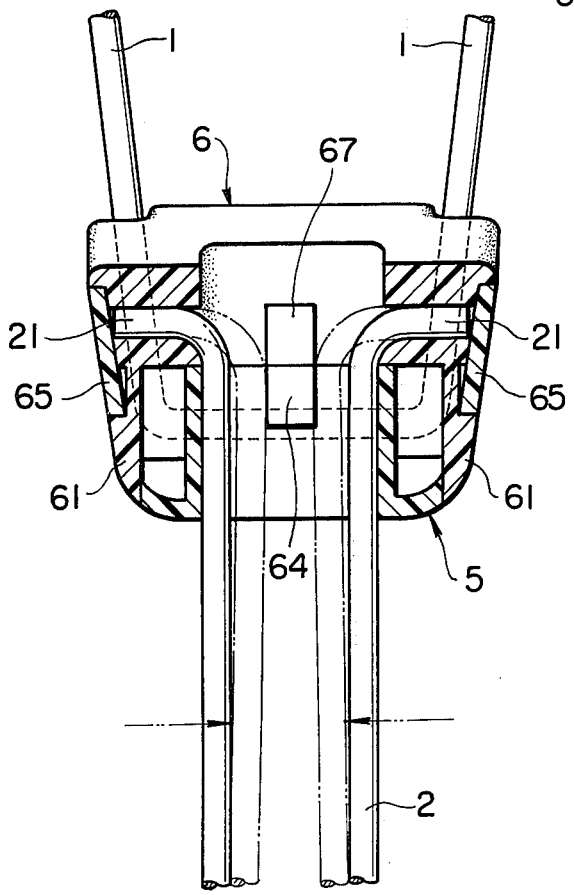
FIG. 5 is a front elevational cutaway view showing the leg assembly according to the present invention.
Figure 6:
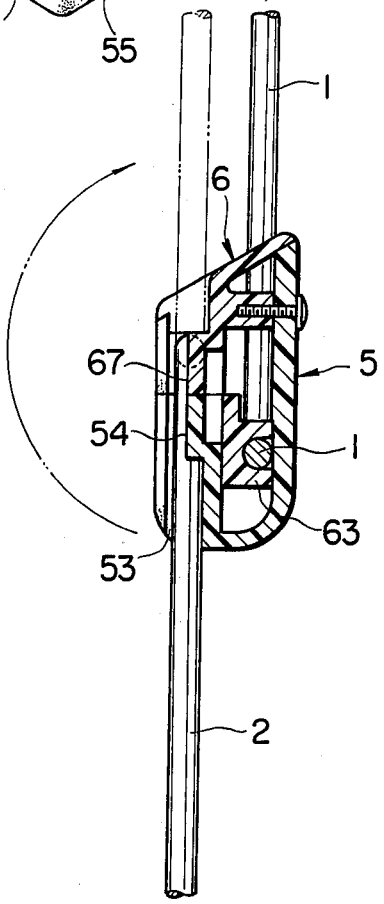
FIG. 6 is a side elevational cutaway view showing the leg assembly according to the present invention.

The connecting member 3 is obtained by molding hard synthetic resin, and comprises, as shown in FIGS. 3 and 4, an outer frame 5 and an inner frame 6 to be fitted into the outer frame 5.

The outer frame 5 is formed like a box having a bottom, and has a front wall 51. A recessed wall 52 is formed in the lower half of the front wall 51. Groove-shaped parts of the outer frame connecting both sides of the recessed wall 52 and the front wall 51 are employed as groves 53 adapted to receive the two legs of the lower member 2 which tend to open outwardly. A stopper 54 is provided on the front surface of the recessed wall 52. If, when the leg assembly is folded, the two legs of the lower member 2 are forced to come nearer than a predetermined distance, the pivotal rods 21, or the two end portions, of the lower member 2 are disengaged from the connecting member 3. In order to prevent such disengagement, the stopper 54 is provided. Designated by 55 are through-holes provided in the lower halves of the side walls of the outer frame 5. Engaging protrusions 61 extended downwardly from the side walls of the inner frame 6 are engaged with the through-holes 55. As was described above, the inner frame 6 is designed to be fitted into the outer wall 5. A groove 63 whose section is like a letter "C" is provided in the lower end portion of the rear wall 62 of the inner frame 6. The lower horizontal part of the upper member 1 is engaged with this groove 63. The inner frame further comprises vertically extended grooves 64 into which the vertically extended parts of the upper member 1 are fitted (FIG. 3), and fitting grooves 66 whose sections are like a letter "C". The fitting grooves 66 are provided near the lower end portion of the front wall 65 of the inner frame 6 and are adapted to receive the pivotal rods 21 of the lower member 2. Designated by 67 is a stopper provided in the front wall 65 of the inner frame 6. The stopper 67 is so formed that it will align with the stopper 54 of the outer frame 5 and cooperate with the latter (FIG. 4).

The groove 63 whose section is like a letter "C" as shown in FIG. 3 is provided near the lower end portion of the rear wall 62 of the inner frame 6 for fitting the horizontal part of the upper member 1 thereinto, while the grooves 64 are provided along the side walls of the inner frame 6 so as to fit the vertically extended parts of the upper member 1 therein, respectively. Accordingly, the concerned parts of the upper member are completely fitted in and supported by the inner frame 6, and the outer frame 5 is employed merely as a cover of the inner frame. In consequence, the leg assembly according to this invention is greatly different from that in the previously mentioned Utility Model Application to which a dynamic strength is complementarily aplied by its outer frame 5. The outer frame 5 according to this utility model serves as a cover also for the mounting parts of the lower member 2. Merely by fitting the pivotal rods 21 of the lower member 2 into the fitting grooves 66 provided near the lower end part of the front wall 65 of the inner frame 6, the lower member 2 can be securely and positively connected to the inner frame 6, and therefore all that is required for the outer frame 5 is to prevent the lower member from being disengaged from the inner frame 6, or the connecting member 3, unintentionally.

The leg assembly can be folded as follows: If the upper end portions of the two legs of the "V"-shaped lower member 2 near the pivotal rods 21 are squeezed together against the elastic force of the lower member 2, the upper part of the legs can be readily disengaged from the grooves 53, respectively, and therefore the leg assembly can be readily folded in two about the pivotal rods 21. In this case, the upper end portions of the lower member 2, or the pivotal rods 21, are completely enclosed in the outer frame 5. Accordingly, unlike the conventional folding type leg assembly, the leg assembly of the present invention has no protruding parts and is therefore not hazardous to babies.

What is claimed is:

1. A foldable leg assembly for a baby's go-cart comprising an upper member, a lower member and a connecting member; said upper member being generally U-shaped, said lower member having two legs biased away from one another at the upper end thereof and terminating in outwardly extending pivotal posts; said connecting member comprises in combination an outer frame and an inner frame, each of hard synthetic resin, said outer frame having the form of a box with a bottom and having in the central lower half of a front wall thereof a recessed wall, said front wall and said recessed wall coming together and defining facing grooves for receiving said legs respectively of said lower member, said inner frame shaped to fit into said outer frame and having a groove whose section is like a letter "C", said latter groove being adapted to engage with the cross portion of said U-shaped upper member, and having a pair of elongate grooves formed along both sides of said latter groove for receiving the vertically elongated parts of said upper member therein, and having a pair of pivot grooves for fitting said pivotal posts therein provided near the lower end portion of a front wall of said inner frame whereby the squeezing together of said two legs frees said legs from said grooves in said outer frame to permit pivoting of said lower member about said pivotal posts so that said leg assembly can be folded.

* * * * *